US007022027B2

(12) United States Patent
Chen

(10) Patent No.: US 7,022,027 B2
(45) Date of Patent: Apr. 4, 2006

(54) TRI-WEIGHT CORRELATED SET OF IRON TYPE GOLF CLUBS

(76) Inventor: Ming T. Chen, 45 E. Herbert Ave., Salt Lake City, UT (US) 84111

( * ) Notice: Subject to any disclaimer, the term of this patent is extended or adjusted under 35 U.S.C. 154(b) by 0 days.

(21) Appl. No.: 10/656,819

(22) Filed: Sep. 5, 2003

(65) Prior Publication Data

US 2005/0054458 A1 Mar. 10, 2005

(51) Int. Cl.
*A63B 53/04* (2006.01)

(52) U.S. Cl. ..... 473/291; 473/350

(58) Field of Classification Search ..... 473/290–291, 473/350, 324; D21/748
See application file for complete search history.

(56) References Cited

U.S. PATENT DOCUMENTS

D164,596 S * 9/1951 Penna ..... D21/751
3,250,536 A 5/1966 Moser
3,655,188 A 4/1972 Solheim
3,751,035 A 8/1973 Lockwood
3,814,437 A 6/1974 Winquist
3,845,960 A 11/1974 Thompson
4,322,083 A 3/1982 Imai
4,326,326 A 4/1982 MacDonald
D267,965 S 2/1983 Kobayashi
D268,775 S 4/1983 Pace
D269,101 S 5/1983 Reymann, Jr. et al.
4,420,156 A 12/1983 Campau
D276,644 S 12/1984 Solheim
4,512,577 A 4/1985 Solheim
4,621,813 A 11/1986 Solheim
4,715,601 A 12/1987 Lamanna
4,957,294 A * 9/1990 Long ..... 473/350
5,026,056 A 6/1991 McNally et al.
5,048,834 A * 9/1991 Gorman ..... 473/350
5,160,137 A 11/1992 Katayama
5,547,194 A 8/1996 Aizawa et al.
5,564,705 A 10/1996 Kobayashi et al.
D377,381 S 1/1997 Takahashi et al.
5,616,088 A 4/1997 Aizawa et al.
5,658,209 A 8/1997 Blakemore
D401,637 S * 11/1998 Best et al. ..... D21/747
5,913,735 A 6/1999 Kenmi
D413,369 S 8/1999 Peng (Continued)

*Primary Examiner*—Stephen Blau

(57) ABSTRACT

A tri-weight correlated set of iron-type golf clubs, wherein at least two of the clubs of the set have a combined sole weight and center weight, which reinforces the most likely hitting surface of the club to add distance behind well hit center shots, and a periphery weight system along the heel and toe to straighten out off-center hit shots.

3 Claims, 1 Drawing Sheet

U.S. PATENT DOCUMENTS 5,976,033 A 11/1999 Takeda
D435,277 S 12/2000 Erickson et al.
D437,902 S 2/2001 Persinger
D444,195 S 6/2001 Wahl et al.
D453,949 S 2/2002 Helmstetter et al.
D454,932 S 3/2002 Mahaffey et al.
D458,328 S 6/2002 Solheim et al.
6,406,382 B1 6/2002 Deshmukh et al.
6,454,665 B1 9/2002 Antonious
D466,960 S 12/2002 Imamoto
D468,788 S 1/2003 Bode et al.
D469,140 S 1/2003 Best
6,551,200 B1 * 4/2003 Golden et al. ..... 473/349
6,554,722 B1 4/2003 Erickson et al.
D475,108 S * 5/2003 Madore ..... D21/759
2003/0013545 A1 1/2003 Vincent et al.
2003/0114245 A1 6/2003 Kusumoto et al.
2003/0236134 A1 * 12/2003 Nishitani ..... 473/349

* cited by examiner

TRI-WEIGHT CORRELATED SET OF IRON TYPE GOLF CLUBS

BACKGROUND OF THE INVENTION

1. Field

This invention relates to golf clubs, and more particularly to golf club irons, having a tri-weight system which improves the performance of miss hits on the club face and also reinforces the club face for center hits.

2. State of the Art

A large number of different golf club iron sets are known. Correlated sets of golf clubs have club striking faces with increasing angles of attack to loft a ball a desired distance. The club heads are also increasingly weighted, and the shafts are decreasingly shortened to maintain consistent swing momentum so that each club swing, if properly hit, decreases the distance the golf ball travels by approximately 10 yards. For example, in a correlated set, each club head weight generally increases approximately 7 grams per increase in club number. However, each shaft length incrementally decreases about ½ inch for a steel shaft per increase in club number. Shaft types and lengths vary depending upon the swing of a golfer. For example, the majority of golfers fall into the average swing category, and have a 65 to 85 mph swing speed requiring a shaft with a low flex point and approximately a 4.0 torque rating. Conversely, professional golfers having a 100 to 115 mph swing speed require a shaft with a mid or high flex point with a 2.0 or so torque rating.

The angle of the club face also increases per increase in the club number to add loft to the flight of the golf ball. The weighted center of gravity of the club also moves up per increase in club number. A typical set has the following specifications:

SPECIFICATIONS

| | Club | | | | | | | | |
|---|---|---|---|---|---|---|---|---|---|
| | 1 | 2 | 3 | 4 | 5 | 6 | 7 | 8 | 9 |
| Loft | 16° | 18° | 21° | 24° | 28° | 32° | 36° | 40° | 44° |
| Lie* | 56° | 57° | 58° | 59° | 60° | 61° | 62° | 63° | 64° |
| Weight** | 223 | 240 | 247 | 254 | 261 | 268 | 275 | 282 | 289 |

*Lie—plus or minus 0.5 degrees
**Weight—plus 2 gr. or minus 2 gr.

A few golf club irons are designed to enable a golfer to off center hit the ball on the club face and maintain shot alignment. Thompson, U.S. Pat. No. 3,845,960, and Imai, U.S. Pat. No. 4,322,083, are examples of sole reinforced iron clubs which add mass along the sole of the club to optimize distance. Blakemore, U.S. Pat. No. 5,658,209 discloses a center reinforced mound placed in a cavity club. Best, U.S. Pat. No. D469,140S is another center reinforced mound placed in a cavity club. Although distance is increased, heel or toe off center hit shots do not maintain shot alignment. Nor do shots hit on the upper unreinforced face of the club maintain distance.

For those golfers who consistently hit their shots along the toe of the club, a number of toe weighted clubs have been designed: Lamanna, U.S. Pat. No. 4,715,601, Solheim, U.S. Pat. No. 3,655,188, and Campau, U.S. Pat. No. 4,420,156.

Solheim, U.S. Pat. No. 4,621,813, discloses a correlated set of golf clubs with back cavities, the heads of which each contain (1) a sole including a trailing edge 65 which is indented toward the striking face a distance of at least 1/16 of an inch, and (2) a lower back surface adjacent the indented trailing edge sloping upwardly and inwardly from the indented trailing edge toward the striking face. This configuration allows the club head material, which would otherwise be located in the indented areas to be redistributed in the heel and toe portions of the club heads. The redistributed head materials increase the mass concentrations in the heel and toe areas, which improves the resistance to twisting of the club heads upon off-center heel and toe impacts with the golfball. Another example of a back cavity club with heel and toe reinforcement is Lockwood, U.S. Pat. No. 3,751,035, Kobayashi et al., U.S. Pat. No. 5,564,705, and Persinger, U.S. Pat. No. D437,902S. The center cavity club designs maintain alignment, but do not allow an off center hit shot to maintain consistent distance. Nor do center hit shots achieve optimum distance as the center face of the club does not have sufficient mass behind it.

Antonious, U.S. Pat. No. 6,454,665B2 included unique weighting stabilizing and reinforcing configuration of the rear face of a cavity back peripheral weight club head in an attempt to remove this well hit shot distance deficiency. Peng, U.S. Pat. No. Des. 413,369 and Takahashi et al, U.S. Pat. No. Des. 377,381 also attempted to include center weights within the cavity to remove this distance deficiency.

McNally et al, U.S. Pat. No. 5,026,056, discloses another heel-toe balancing club. McNally et al. discloses a correlated set of golf clubs of the iron type in which each club head has a cavity formed in the back surface thereof with specially configured weight pads formed integrally within the back cavity. The weight pads are so configured and positioned within the con-lines of the back cavity as to create desired heel-toe balancing of each club head wherein each club head's center of gravity is physically centered, both horizontally and vertically of the club head, behind the visually-perceived optimal striking point, i.e., the apparent visual center of percussion of the club's striking face relative to the golf ball at address. This configuration is designed to provide better club balance, and minimize misdirection of heel or toe off center hit shots. Other examples of heel-toe balancing clubs are: Reymann, Jr. et al., U.S. Pat. No. Des. 269,101, Solheim, U.S. Pat. No. Des. 276,644, and Solheim, U.S. Pat. No. D458,328S, which also includes a sole center weight in the cavity.

These cavity backed clubs do not provide a solid mass behind the club face center to maximize hitting distances. To overcome this lack of center of mass, the Merit Fusion/Nicklaus Nl provides a set of correlated golf clubs with an iron weight bar placed within the inside of the back cavity which can be adjusted vertically to promote vertical balancing for an exact center of gravity as well as provide additional mass behind the club face. MacDonald, U.S. Pat. No. 4,326,326 is another example of a lead insert golf club head positioned directly behind the center of the intended striking surface to improve distance. Other examples of center reinforced golf club heads are: Winquist, U.S. Pat. No. 3,814,437,Kobayashi, U.S. Pat No. Des. 267,965, Pace, U.S. Pat. No. Des. 268,775, and Aizawa et al., U.S. Pat. No. 5,547,194. Katayama, U.S. Pat. No. 5,160,137 discloses a bubble weighted club with rearward projecting sole. Gorman, U.S. Pat. No. 5,048,834 discloses a center mound weight within the cavity, but is a flat piece not including any periphery weighting reinforcement. Wahl et al., U.S. Pat. No. D444,195S discloses a club with a center weight reinforcement cavity design.

Unfortunately, these center reinforced cavity configurations also raise the center of gravity of the club face, thereby reducing the mass along the lower center of the club face proximate the sole where maximum leverage striking force for an iron shot is delivered. Indeed, the Pace design actually raises the center of gravity. Ming T. Chen and Jeffrey R. Thurman patented a dual weighted iron golf club, which included perimeter weights designed to straighten miss hit iron shots, and a center weight within the back of the cavity behind the club face to provide added distance to properly hits shots in U.S. Pat. No. 5,356,138. Claim 1 of said patent was invalidated in the DISTRICT OF UTAH, CENTRAL DIVISION PRO SPORTS, USA, vs. MIZUNO USA-Golf Division, Case No. 2:98-CV-866-S by the Honorable Ted Stewart who interpreted Claim 1 to require that the center mound weight was positioned above the thickness of the sole and was therefore anticipated by certain references.

Bode et al., U.S. Pat. No. D 468,788S discloses another dual weight iron club similar to Chen with a rear projecting sole. Mahaffey et al, U.S. Pat. No. D454. 932 S discloses another iron club with a rearward projecting thickened combination sole/center weight. Helmstetter et al, U.S. Pat. No. D453,949S discloses a another iron club with a complex cavity back design Erickson et al., U.S. Pat. No. Des. 435,277 discloses a cavity backed club with a thickened combination sole/center weight which does not project rearward. Erickson et al., U.S. Pat. No. 6,554,722B2 discloses a bi-material weight added to the design of U.S. Pat. No. Des. 435,277. Imamoto, U.S. Pat. No. D466,960S discloses a club similar to Erickson et al., with an added center portion.

There are other solid backed clubs still used by professionals and other golfers with consistent swings, who consistently hit the ball in the center of the club face to acquire consistent optimum distance and loft. As most golfers do not have a consistent swing, and often miss hit the ball, various manufacturers started developing wider club heads for their needs. To insure that the club heads still had the same weight, these manufacturers developed hollows or cavities in the back of the club to spread the weight over a wider club head in essentially two types of patterns: 1) muscle backed clubs with center weights mounted behind the hitting surface on the back without a cavity, and 2) perimeter weighted clubs with weights behind the heel and toe on both sides of the cavity behind the club hitting surface. The muscle backed clubs did not straighten out miss hit shots striking the heel and toe of the club. Conversely, the perimeter weighted clubs self corrected miss hit shots on the heel and toe of the club, but lacked center weight to add distance to properly hit center struck shots.

Aizawa et al., U.S. Pat. No. 5,616,088 discloses a golf club head with rearward extending upper and lower flanges on the peripheral backside of a club head projecting rearwardly to enhance the moment of inertia and improve direction stability of a ball.

Other patents of interest are: Solheim, U.S. Pat. No. 4,512,577, discloses a set of correlated golf clubs, the heads of which are provided with a narrowed neck connecting the main body of the club head to the hosel. The midsection of the neck has a cross section of maximum dimension less than the diameter of the hosel so that, when the main body of the club head twists under impact with a ball, the narrowed neck will function as a torsion bar with twisting tension occurring in the mid-section. In that manner, the twisting motion of the main body is uncoupled from the hosel and shaft to provide a more forgiving shock absorbing club head in the event an iron shot is miss hit This shock absorbing feature does not give consistent distance to a miss hit ball.

Moser, U.S. Pat. No. 3,250,536, is an example of a sand wedge with a reinforced weighted club having a different density filling material filing a cavity in the back of the club to balance the club.

Kenmi, U.S. Pat. No. 5,913,735 disclosing a metallic golf club head having a hollow head body with a sole member formed on an interior surface of the sole member.

Vincent et al., U.S. Pat. No. 2003/0013545A1 discloses a golf club iron having a sole with recesses into which different inserts may be inserted to dissipate vibration.

Takeda, U.S. Pat. No. 5,976,033 discloses a golf club with structure for securing balancing weights to the back of the club head.

Deshmuky et al., U.S. Pat. No. 6,406,382B1 discloses a golf club with a multiple material weighting member using liquid phase sintering, preferably a high-density component, a binding comp0onent and an anti-oxidizing component.

Kusumoto et al, U.S. Pat. No. 2003/0114245A1 discloses a golf club height containing 15 wt. % or greater of iron and tungsten, and having a specific gravity of 9 or larger joined to a steel or pure iron head body by welding.

There thus remains a need for a rear cavity weighted club which maintains a low center of gravity while providing additional mass behind the center most likely segment of the striking surface of the club to optimize shot distance and move the center of gravity of the club rearward to assist in maintaining alignment even though the shot is hit off center near the toe, heel, or upper segment of the club face. The golf club set described below provides such an invention.

SUMMARY OF THE INVENTION

The present invention comprises a tri weight correlated set of iron-type golf clubs. At least two of the clubs of the set have a tri-weight mass positioned to reinforce the most likely hitting surface of the club and provide perimeter weighting of the toe and heel to straighten out off center hits. The tri-weight correlated set of iron-type golf clubs have the same swing weight, and at least two clubs of the set are configured with a shaft and with a handle attached to a head. The head has a neck to attach to the shaft, and a face with a hitting surface for impacting a golf ball. They have sides, a top, a back surface behind the hitting surface, and a bottom sole structured to align with the ground and having a heel, and a toe. A first reinforcement sole weight system is attached behind the back surface of the club along the bottom sole. Its mass thickness is structured such that the height (xy-direction) of its sole mass curvilinearly rises with short linear and/or curved segments from a low point proximate the heel, increases along the sole to a peak reinforcing the middle segment of the lower back surface of the club behind the most probable hitting surface, and thereafter curvilinearly declines with short linear and/or curved segments to a low point proximate the toe of the bottom of the sole. It has a depth (yz-direction) of its sole mass curvilinearly rising with short linear and/or curved segments increasing in thickness from a least thickness proximate the heel and increasing along the bottom of the sole in depth to reinforce the middle of the lower back surface of the club behind the lower segment of the hitting surface and thereafter decreasing in thickness with short linear and/or curved segments to a least thickness proximate the toe along the sole. The sole mass thus adds center weight with most mass placed behind the lower portion of the club face most probable to impact a golf ball during repetitive strokes and least mass proximate the toe and heel. It has increasing mass toward the center of the club to provide a low center of gravity, which is farther back from the club face to increase resistance to twisting from miss hit shots, while adding distance to well hit center shots.

A second periphery balancing weight system is placed along the top and sides of the back surface of the club head. Preferably the second periphery balancing weight system is structured to contact the sole weight, thereby defining a cavity in said back surface. The periphery balancing weight structure has least weight and thickness starting at the top of the back surface and gradually increases in weight and thickness toward the sole of the club to lower the center of gravity of the club. It provides better balance and strength behind the periphery of the hitting surface the face of the club to resist twisting of the club when contacted by an off-center hit to aid in maintaining shot alignment.

A third center weight system is attached to the back surface behind the hitting surface above the sole weight with structure to reinforce the upper segment of the most probable contact segments of the hitting surface above the sole weight and add distance to off-center high hits.

In a preferred embodiment of the tri-weight set of iron-type golf clubs, the height of the center weights extend to greater heights depending on the iron number. Preferably, the mass of the sole weight is positioned behind the lower portion of the hitting surface of the club face wherein approximately 85% of the shots leave the face of the hitting surface after being struck. In another preferred embodiment, the mass is positioned behind the lower portion of the hitting surface of the club face wherein a Gaussian distribution of random repetitive shots leave the face of the hitting surface after being struck.

In one preferred embodiment to reduce mass, the periphery balancing weight structure along the back of the toe may have a first rounded depression leading into the back cavity.

The three weight systems therefore provide a club with a very low center of gravity, while distributing weight along the heel and toe to straighten out off-center hit shots, and reinforce the most likely hitting surface to add distance behind well hit shots.

Each club is made of 431 steel or similar material, and has a neck to attach to a shaft, preferably made of graphite materials. The club has an angled face for impacting a golf ball, a back surface, a heel portion, a toe portion, and a sole. Attached to the back of the club is a reinforcement periphery balancing weight structure placed along the perimeter. This reinforcement periphery balancing weight structure defines a captivated back of the club, and provides increasing weight and thickness behind the toe and heel of the club. The mass behind the heel and toe has least weight and thickness at the top of the club and gradually increases in thickness toward the sole of the club. This weight distribution not only provides better balance and strength behind the periphery of the hitting surface of the face of the club, but lowers the center of gravity of the club to provide most of the mass along the sole of the club to maximize hitting distance. It also provides mass behind the heel and toe of the face to maintain shot alignment for off center shots hit in the toe and heel regions of the club face. Mounted within the back cavity of the club above the sole weight is a third mound weight reinforcing structure partially filling the upper segment of the back cavity of the iron behind the upper most likely hitting surface of the club. The combined masses of the sole weight and the center weight thus provide added mass behind the hitting surface where 85% of the shots contact and leave the hitting surface after being struck as reflected by a Gaussian distribution. Thus, the height of the combined mound and sole weight increases as the number of each club increases. This is because the increasing club head has a greater angled hitting surface, which allows struck balls to leave the hitting surface farther up on the club face. To insure that these shots have sufficient mass behind them to add distance to the higher iron shots, the weighted mound extends higher behind the hitting surface with higher irons.

The invention thus provides an improved tri weight golf club set, which not only maintains shot alignment for off center heel and toe iron shots, but provides added distance to well hit center shots.

DESCRIPTION OF THE ILLUSTRATED EMBODIMENTS

Figure 1A:
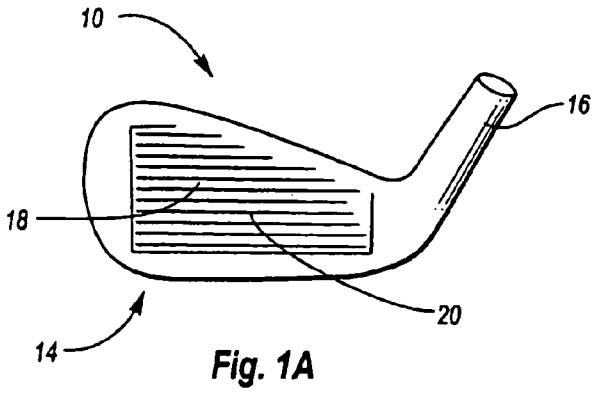
FIG. 1*a* illustrates a perspective view of the front of the preferred embodiment of the invention shown in FIG. 1.
Figure 2:
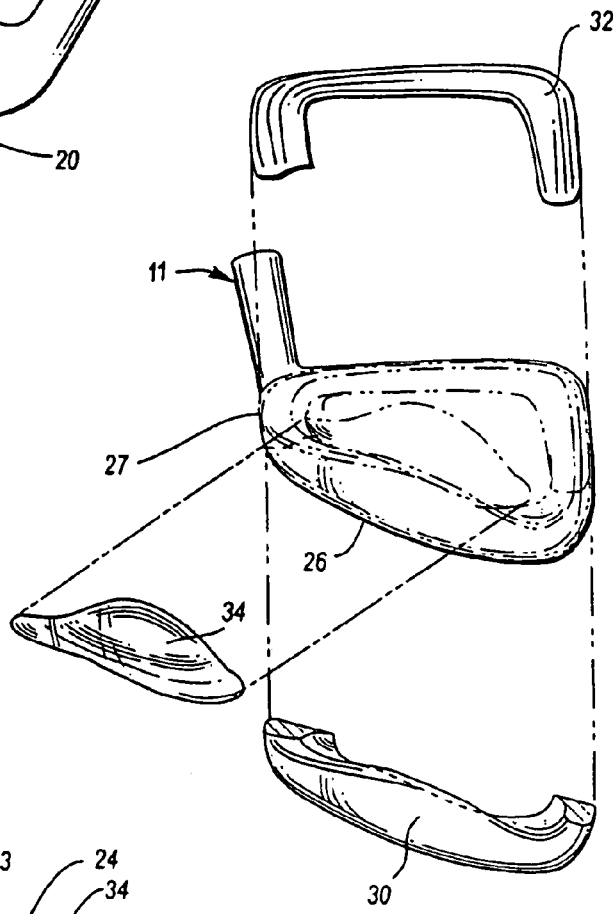
FIG. 2 illustrates an exploded view of the preferred embodiment of the invention shown in FIG. 1.
Figure 1:
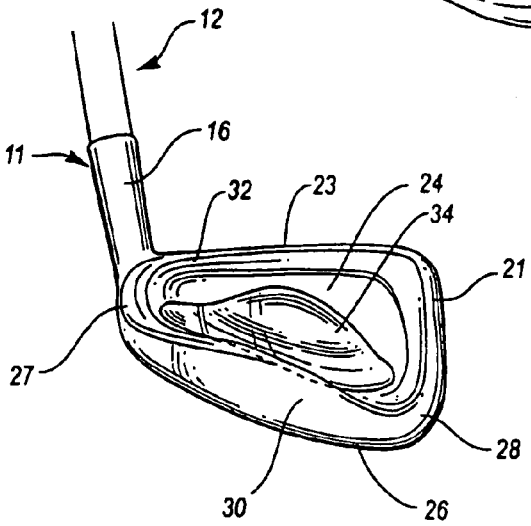
FIG. 1 illustrates a perspective view of the back of a preferred embodiment of the invention.

FIG. 1 illustrates the back of a preferred embodiment of the tri weight correlated set of iron-type golf clubs 10. At least two of the clubs 10 of the tri weight correlated set of iron-type golf clubs 10 have a tri-weight mass system positioned to reinforce the most likely hitting surface of the club and provide perimeter weighting of the toe and heel regions to straighten out off center hits. The tri-weight correlated set of iron-type golf clubs 10 have the same swing weight, with at least two clubs 10 of the set configured with a shaft 12 with a handle (not shown) attached to a head 14. The head 14 has a neck 16 to attach to the shaft 12, and a face 18 shown in FIG. 1 a with a hitting surface 20 shown in FIG. 1*a* for impacting a golf ball. They have sides 21, a top 23, a back surface 24 behind the hitting surface 20, and a bottom sole 26 structured to align with the ground and having a heel 27, and a toe 28. A first reinforcement sole weight system 30 is attached behind the back surface 24 of the club along the bottom sole 26. Its mass thickness is structured such that the height (xy-direction) of its sole mass curvilinearly rises with short linear and/or curved segments from a low point proximate the heel 27, increases along the sole 26 to a peak reinforcing the middle segment of the lower back surface 24 of the club behind the most probable hitting surface 20, and thereafter curvilinearly declines with short linear and/or curved segments to a low point proximate the toe 28 of the bottom of the sole 26. It has a depth (z-direction) of its sole mass curvilinearly rises with short linear and/or curved segments increasing in thickness from a least thickness proximate the heel 27 and increasing along the bottom of the sole in depth to reinforce the middle of the lower back surface 24 of the club behind the lower segment of the hitting surface 20 and thereafter decreasing in thickness with short linear and/or curved segments to a least thickness proximate the toe along the sole 26. The sole mass thus adds center weight with most mass placed along the lower portion of the club face most probable to impact a golf ball during repetitive strokes and least mass proximate the toe and heel. It has increasing mass toward the center of the club to provide a low center of gravity, which is farther back from the club face to increase resistance to twisting from miss hit shots, while adding distance to well hit center shots.

A second periphery balancing weight system 32 is placed along the top 23 and sides 21 of the back surface 24 of the club head 14. Preferably the second periphery balancing weight system 32 is structured to contact the sole weight 30, thereby defining a cavity in said back surface 24. The periphery balancing weight structure has least weight and thickness starting at the top 23 of the back surface 24 and gradually increases in weight and thickness toward the sole 26 of the club to lower the center of gravity of the club. It provides better balance and strength behind the periphery of the hitting surface of the face of the club to resist twisting of the club when contacted by an off-center hit to aid in maintaining shot alignment.

A third center weight system (34) is attached to the back surface (24) behind the hitting surface (20) above the sole weight (30) with structure to reinforce the upper segment of the most probable contact segments of the hitting surface (20) above the sole weight and add distance to off-center high hits.

In a preferred embodiment of the tri-weight set of iron-type golf clubs (11), the height of the center weight system (34) extends to greater heights in direct proportion to the iron number. Preferably, the mass of the sole weight is positioned behind the lower portion of the hitting surface of the club face (18) wherein approximately 85% of the shots leave the face (18) of the most likely hitting surface (20) after being struck. In another preferred embodiment, the mass is positioned behind the lower portion of the most likely hitting surface (20) of the club face wherein a Gaussian distribution of random repetitive shots leave the face of the hitting surface after being struck.

Although this specification has made reference to the illustrated embodiments, it is not intended to restrict the scope of the appended claims. The claims themselves recite those features deemed essential to the invention.

I claim:

1. A tri weight correlated set of iron-type golf clubs with tri-weight mass having the same swing weight, wherein at least two clubs of the set, comprise:

a. a shaft with a handle, b. a head having i. a neck to attach to the shaft, ii. a face with a hitting surface for impacting a golf ball, iii. sides, iv. a top, v. a back surface behind the hitting surface, vi. a bottom sole structure to align with the ground having a heel, and a toe, vii. a first reinforcement sole weight system attached behind the back surface of the club along the bottom sole with its mass thickness structured such that 1. the height (xy-direction) of its sole mass curvilinearly rises with short linear and/or curved segments from a low point proximate the heel, increases along the sole to a peak reinforcing the middle of the lower back surface of the club, and thereafter curvilinearly declines with short linear and/or curved segments to a low point proximate the toe of the bottom of the sole, and 2. the depth (z-direction) of its sole mass curvilinearly rises with short linear and/or curved segments increasing in thickness from a least thickness proximate the heel and increasing along the bottom of the sole in depth to reinforce the meddle of the lower back surface of the club behind the lower segment of the hitting surface and thereafter decreasing in thickness with short linear and/or curved segments to a least thickness proximate the toe along the sole to add center weight with least mass proximate the toe and heel and increasing mass toward the center of the club to move back and lower the center of gravity from the club face to increase the moment of inertia of the club and reduce twisting caused by off-center hits while adding distance to well hit center shots, viii. a second periphery balancing weight system placed along the top and sides of the back surface of the club dead structured to contact the sole weight, thereby defining a cavity in said back surface, said periphery balancing weight structure having least weighty and thickness starting at the top of the back surface and gradually increasing in weighty and thickness toward the sole of the club to lower the center of gravity of the club and provide better balance and strength behind the periphery of the hitting surface of the face of the club to assist in resisting twisting of the club when contacted by an off-center hit to aid in maintaining shot alignment, and ix. a third center weight system attached to the back surface behind the hitting surface above the sole weight with structure to reinforce the upper segment of the hitting surface above the sole weight and add distance to off-center higher hits.

2. A tri-weight correlated set of iron-type golf clubs according to claim 1, wherein the height of the center weights extend to greater heights depending on the iron number.

3. A tri-weight correlated set of iron-type golf clubs according to claim 1, wherein the periphery balancing weight structure along the back of the toe defines a first rounded depression leading into the back cavity.

* * * * *